United States Patent [19]

Evans

[11] Patent Number: 5,060,829

[45] Date of Patent: Oct. 29, 1991

[54] PRODUCT CONDITIONING UNIT

[76] Inventor: Glen R. Evans, 18183 285th St., Shafer, Minn. 55074

[21] Appl. No.: 468,130

[22] Filed: Jan. 22, 1990

[51] Int. Cl.[5] ..... B67D 5/62; B05B 1/24

[52] U.S. Cl. ..... 222/146.3; 239/135

[58] Field of Search ..... 222/146.3, 129, 190, 222/130, 146.2; 239/135, 128

[56] References Cited

U.S. PATENT DOCUMENTS

| | | | |
|---|---|---|---|
| 3,217,938 | 11/1965 | Ayres | 239/135 |
| 3,291,346 | 12/1966 | Marraffino | 239/135 |
| 3,292,823 | 12/1966 | Weidman et al. | 239/135 |
| 3,338,477 | 8/1967 | McKinnie et al. | 239/135 |
| 3,341,079 | 9/1967 | Marraffino | 222/146.3 |
| 3,358,882 | 12/1967 | Mathison | 222/130 |
| 3,370,756 | 2/1968 | McKinnie | 222/146.3 |

*Primary Examiner*—Andres Kashnikow
*Assistant Examiner*—Lesley Morris
*Attorney, Agent, or Firm*—Lawrence M. Nawrocki

[57] ABSTRACT

A vessel is provided and comprises a closed fluid container. A pressure type product delivery structure passes through sealed opening in said vessel, terminating in the bottom interior region of vessel. Upper region of the vessel is provided with an opening to admit and empty water. The water opening is fitted with a tight fitting closure (cap). Upper region of the vessel is provided with a spout which generally forms an opening in and duct from the upper region of vessel. Using this product conditioning unit, pressurized product is conditioned (heated and moisturized) by direct contact with water.

3 Claims, 1 Drawing Sheet

PRODUCT CONDITIONING UNIT

BACKGROUND OF THE INVENTION

I have, through personal use, discovered certain performance faults associated with current shaving products (foam, gel, etc.). Although these shaving products provide lubrication and prevent drying, they do not contribute heat and extra moisture to the shaving area. When these products are released from their pressurized containers, the release of pressure and expansion of the product causes cooling. In addition, it is not economical (in the case of foam) or feasible (in the case of gel) to include enough water in the pressurized product container to provide a generous level of actual moisture.

The (Shaving) Product Conditioning Unit herein described corrects the above listed deficiencies by supplemental conditioning (heating and moisturizing) of these products. Conditioning is achieved by directly contacting these products with hot water to produce hot, moist shaving products, which improve the shaving process compared to conventional methods of product use.

OBJECT

The object of this invention is to provide a product conditioning unit capable of causing a pressurized product (specifically, shaving foam, gel, etc.) to be conditioned (heated and moisturized) by direct contact with water. Another object is to conform this unit to allow easy adaptation to pressurized product containers in current or future use.

DETAIL DESCRIPTION

Structurally

Referring specifically to the drawings.

Numerically

Figure 2:
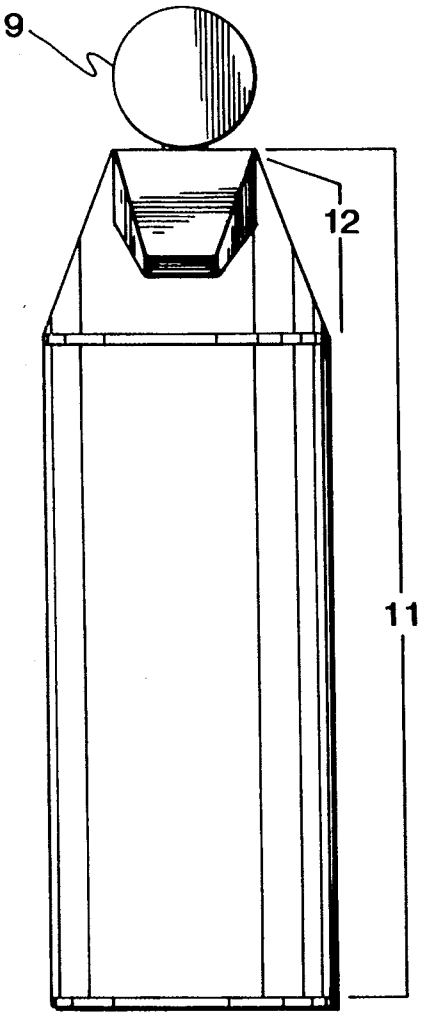
FIG. 2 depicts a frontal view of Product Conditioning Unit.
Figure 1:
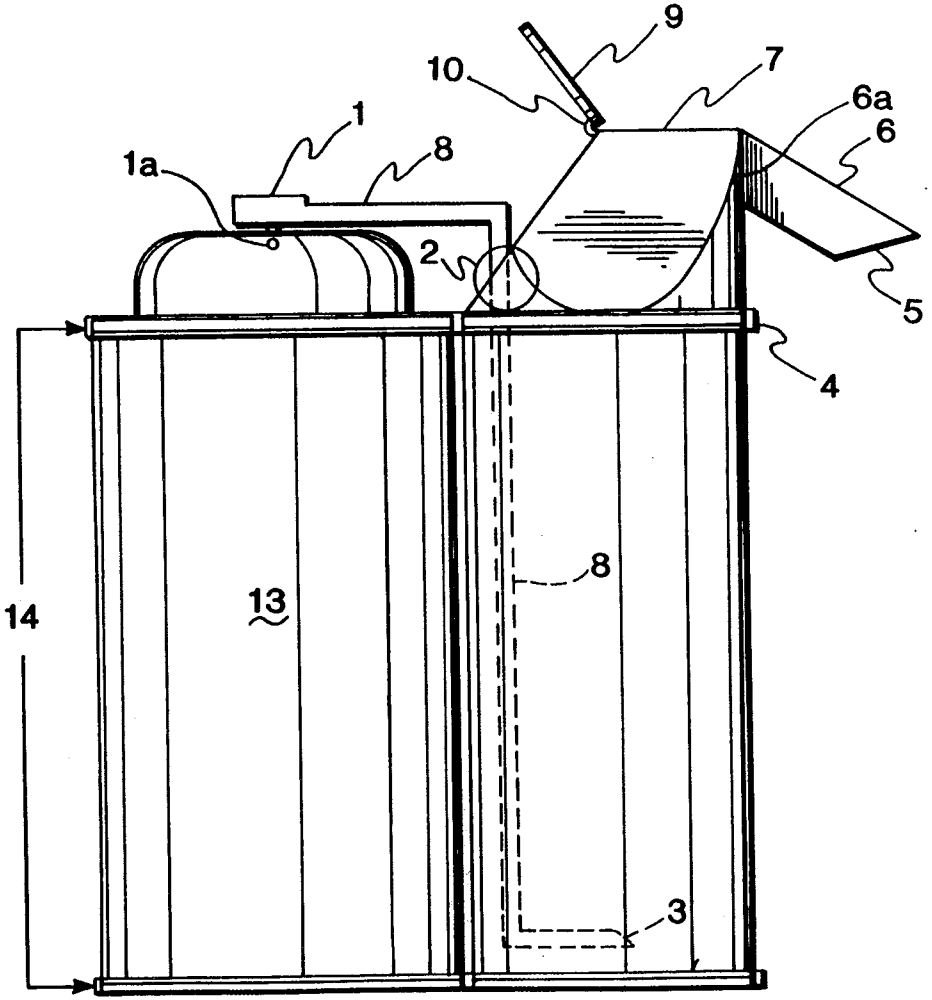
FIG. 1 depicts a side view of Product Conditioning Unit with pressurized product container attached.

The number 1 illustrates an inlet pressure connector.
The number 1*a* indicates pressure valve which releases pressurized product.
The number 2 designates location at which tubes (8) enters, affixes to, and seals to vessel (11).
The number 3 is the outlet of tube (8).
The number 4 is the water level.
The number 5 is the spout outlet.
The number 6 is the spout body.
The number 6*a* is the spout inlet.
The number 7 is the water inlet.
The number 8 is the delivery tube.
The number 9 is the cap/seal.
The number 10 is the cap hinge.
The number 11 is the vessel body.
The number 12 generally designates the upper tapered end (accumulator) of vessel (11).

The number 13 is the pressurized product container.
The number 14 generally indicates structures effecting rigid attachment of vessel body (11) to container (13).

Operationally

First procedure consists of filling vessel body (11) with hot water through water inlet (7). Vessel body (11) is filled with hot water up to water level (4). Hinged seal cap (9) is then placed to cover and seal water inlet (7).

The next procedure of operation begins when downward pressure on inlet pressure connector (1) causes pressure valves (1*a*) to release product from pressurized container (13). After the product passes through pressure valve (1*a*) it enters inlet pressure connector (1) under pressure. The inlet pressure connector (1) then directs flow of pressurized product into delivery tube (8) to which inlet pressure connector (1) is attached. Delivery tube (8) directs flow of pressurized product to lower interior region of vessel body (11). Delivery tube enters, affixes, and seals to vessel body (11) at delivery tube entry point (2). Pressurized product passes from delivery tube (8) at tube outlet (3). After passing tube outlet (3) product is released into hot water contained in vessel body (11). Upon entering water, product rises buoyantly to uppermost water level (4). During passage through water, product acquires heat and moisture by direct contact with water. Upon rising beyond water level (4), hot, moist (conditioned) product is accumulated and directed to spout inlet (6*a*) by means of tapered upper end of vessel (12). Conditioned product enters spout (6) at inlet (6*a*) and then exits at spout outlet (5). Conditioned product is now ready for use. After use water is dumped out at water inlet (7). Product Conditioning Unit is then rinsed out to store until next use.

What is claimed as new is as follows:

1. Apparatus for heating and moisturing shaving cream dispensed from a valve proximate the top of a pressurized container, comprising:

(a) a fluid vessel for holding a hot fluid having a specific gravity greater than that of the shaving cream to be dispensed, said vessel having a vertical dimension approximating a vertical dimension of the pressurized container, said vessel to be disposed in a position laterally proximate, vertically coextensive with, the pressurized container; and (b) conduit means for depositing shaving cream dispensed from the valve into said hot fluid within said fluid vessel proximate a lower extremity of said vessel, when said vessel is disposed laterally proximate the pressurized container.

2. Apparatus in accordance with claim 1 wherein said conduit means comprises a delivery tube extending from the valve proximate the top of the pressurized container, through a wall of said vessel, and to a position proximate a lower extermity of said vessel.

3. Apparatus in accordance with claim 2 wherein said delivery tube comprises a duct extending only laterally and downwardly from the valve of the pressurized container, wherein the flow of shaving cream is facilitated.

* * * * *